United States Patent [19]

Berchtold

[11] Patent Number: 4,566,416

[45] Date of Patent: Jan. 28, 1986

[54] ACCUMULATOR NOZZLE FUEL INJECTION SYSTEM

[75] Inventor: Max Berchtold, Zurich, Switzerland

[73] Assignee: Stanadyne, Inc., Windsor, Conn.

[21] Appl. No.: 605,856

[22] Filed: May 1, 1984

Related U.S. Application Data

[63] Continuation-in-part of Ser. No. 400,237, Jul. 21, 1982, abandoned.

[30] Foreign Application Priority Data

Jul. 31, 1981 [AT] Austria ..... 3371/81

[51] Int. Cl.[4] ..... F02M 39/00

[52] U.S. Cl. ..... 123/458; 123/459; 239/533.8; 239/585

[58] Field of Search ..... 123/458, 459, 514; 239/533.2–533.12, 584, 585

[56] References Cited

U.S. PATENT DOCUMENTS

| | | | |
|---|---|---|---|
| 2,706,520 | 4/1955 | Chandler | 239/533.2 |
| 3,464,627 | 9/1969 | Huber | 239/533.8 |
| 3,481,542 | 12/1969 | Huber | 239/533.8 |
| 3,575,145 | 4/1971 | Steiger | 123/458 |
| 3,610,529 | 10/1971 | Huber | 239/533.8 |
| 3,640,466 | 2/1972 | Steiger | 239/533.8 |
| 3,777,977 | 12/1973 | Regneault et al. | 239/533.8 |
| 3,835,829 | 9/1974 | Links | 123/458 |
| 4,156,560 | 5/1979 | Cheklich et al. | 239/533.8 |

FOREIGN PATENT DOCUMENTS

| | | | |
|---|---|---|---|
| 490943 | 2/1976 | U.S.S.R. | 239/533.2 |

*Primary Examiner*—Magdalen Y. C. Moy

*Attorney, Agent, or Firm*—Prutzman, Kalb, Chilton & Alix

[57] ABSTRACT

A fuel injection system for a diesel engine having a fuel injector with a fuel accumulator chamber connected by an orifice to a fuel source having a pressure controlled by an electronic controller, an injection valve control chamber connected by a second orifice to the fuel source and a solenoid valve controlled by the electronic controller for momentarily releasing the control chamber pressure for momentarily injecting a charge of fuel from the accumulator chamber in a mount and at a rate determined by the source pressure and the pulse width of the solenoid operating pulse.

5 Claims, 2 Drawing Figures

ACCUMULATOR NOZZLE FUEL INJECTION SYSTEM

This application is a continuation-in-part of my copending application Ser. No. 400,237, filed July 21, 1982 and now abandoned and entitled "Apparatus For Injecting Fuel Into An Internal Combustion Engine".

BACKGROUND AND SUMMARY OF THE INVENTION

The present invention relates generally to accumulator nozzle fuel injection systems and relates more particularly to a new and improved accumulator nozzle fuel injection system providing improved control of both the fuel injection rate and the volume of the injected charge.

It is a principal aim of the present invention to provide a new and improved accumulator nozzle fuel injection system for controlling the rate of fuel injection throughout the full speed and load range of the associated internal combustion engine to provide increased engine efficiency, reduced combustion pollutants or an optimum compromise of engine efficiency and reduced pollutants at all operating conditions of the engine. In accordance with the present invention, an accumulator nozzle fuel injection method and apparatus is provided for varying both the accumulator pressure and the injection interval for establishing the rate of fuel injection and the volume of the injected fuel charge. More specifically, throughout the full speed and load operating range of the associated internal combustion engine, the accumulator pressure is controlled to control the rate of fuel injection and both the fuel injection interval and accumulator pressure are controlled to establish the volume of the injected fuel charge.

It is another aim of the present invention to provide a new and improved accumulator nozzle fuel injection method and apparatus for terminating the fuel injection event quickly and cleanly and thereby avoid undesirable end of injection fuel dribble or fuel throttling which reduces combustion efficiency and increases combustion pollutants.

It is another aim of the present invention to provide a new and improved accumulator nozzle fuel injection method and apparatus of the type disclosed in the German application No. 26 47 744 in such a manner that the injection of fuel can be more exactly controlled with regard to the rate of fuel injection and the quantity of fuel injected so that the fuel combustion efficiency is improved and the emission of toxic constituents in the exhaust gas is reduced.

The fuel injection method and apparatus of the present invention is primarily useful with a diesel engine and therefore a diesel engine incorporating an embodiment of the fuel injection system of the present invention is disclosed herein. The disclosed system comprises a common fuel plenum or supply chamber for supplying fuel continuously at a regulated pressure to each of a plurality of fuel injectors of the diesel engine. Fuel is continuously supplied to the common supply chamber by a continuously operating fuel pump. A pressure regulator is provided for the supply chamber for regulating the supply pressure and the supply chamber is directly connected via a fuel inlet manifold to each of the fuel injectors. Each fuel injector has a first fuel storage or accumulator chamber for accumulating fuel at the supply pressure for subsequent injection of fuel when an injection valve needle of the injector is momentarily lifted from its seat. A second fuel control chamber is provided within each fuel injector, connected by a passage constriction or orifice to the fuel inlet of the injector, to provide a closing hydraulic bias at the fuel inlet pressure on the injection valve needle. A solenoid pilot valve is momentarily energized for a selected short interval determined by the width of its operating pulse to momentarily reduce the control chamber pressure to trigger the fuel injection event.

The objects of the fuel injection method and apparatus of the present invention are accomplished through the provision of (a) an accumulator chamber having a volume which is substantially larger than the maximum volume of fuel to be injected throughout the full speed and load range of the associated engine and (b) an accumulator inlet constriction or orifice for restricting the inlet flow rate to the accumulator chamber during the fuel injection event to substantially less than the injection rate. As a result, a quantity of fuel is precompressed in the accumulator chamber adjacent the injection valve opening for subsequent injection without moving a relatively long column of liquid. The volume of the accumulator chamber and the throttling action of the accumulator inlet constriction are selected to obtain the desired relationship between the accumulator pressure drop and the injected volume for accurately controlling both the injection rate and volume and for quickly terminating the fuel injection event without undesirable end of injection fuel dribble or fuel throttling. Also, just as the control chamber is isolated by the first passage constriction, the accumulator chamber is isolated by the second passage constriction and thereby protected from any pressure surge or pressure wave in the inlet pressure manifold which might otherwise adversely affect the precise control of the fuel injection event.

Other objects will be in part obvious and in part pointed out more in detail hereinafter.

A better understanding of the present invention will be obtained from the following detailed description and the accompanying drawings of an illustrative application of the invention.

DESCRIPTION OF THE PREFERRED EMBODIMENT

Figure 1:
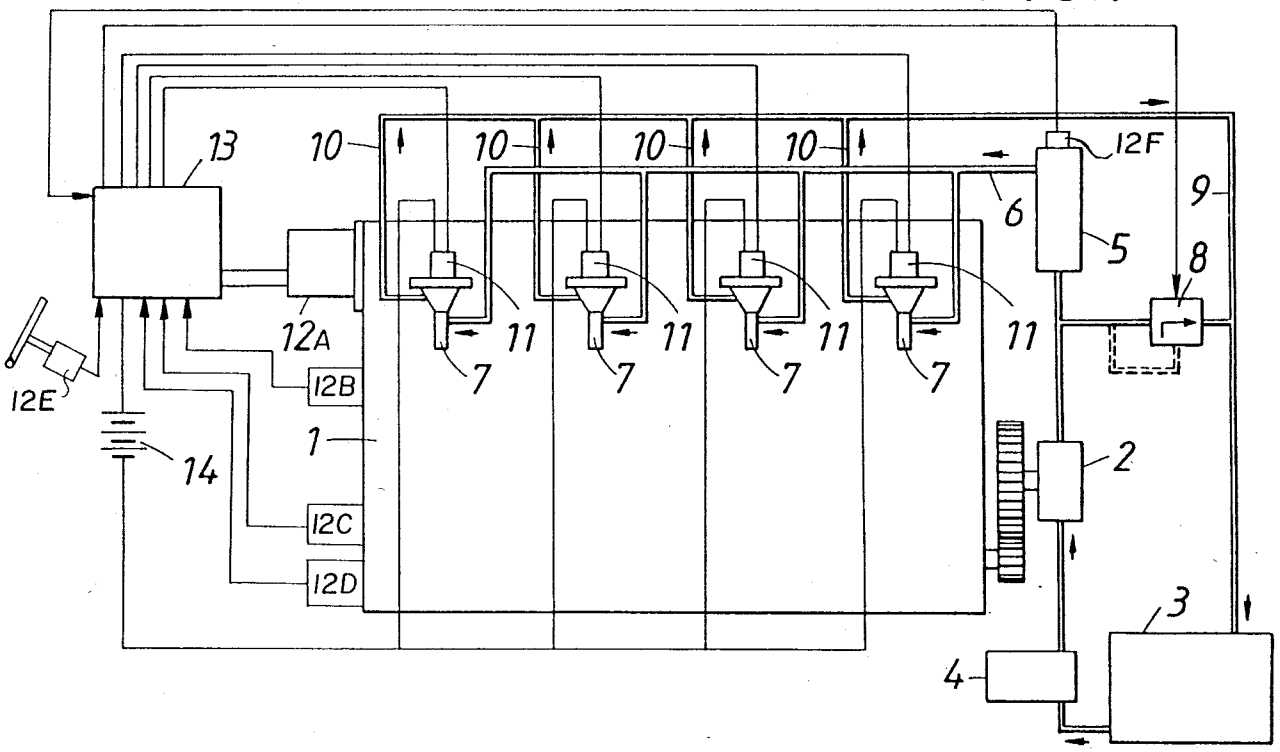
FIG. 1 is a generally diagrammatic view of a four cylinder diesel engine employing an embodiment of a fuel injection system of the present invention.

Referring now to the drawings in detail wherein like numerals are employed to identify the same or like parts and referring in particular to FIG. 1, a four cylinder diesel engine 1 is shown employing an embodiment of an accumulator nozzle fuel injection system of the present invention. The diesel engine 1 is connected to drive a suitable positive displacement fuel pump 2 via a gear transmission. The fuel pump 2 is connected to receive fuel from a fuel tank 3 via a fuel filter 4 and to supply fuel under pressure to a fuel supply chamber 5. The fuel pressure in the supply chamber 5 and also in a fuel inlet manifold conduit 6 leading to the four fuel injectors 7 of the engine is regulated by a pressure control valve or regulator 8. The regulator 8 may provide for automatically increasing the fuel pressure of the supply chamber 5 as the engine speed increases (i.e. in accordance with the volume of fuel delivered by the fuel supply pump 2). Preferably, however, the regulator 8 is controlled by an electronic controller 13 and the controller 13 has a suitable data processor which is programmed to establish the regulated pressure throughout the full speed and load operating range of the engine 1. The pressure regulator 8 returns excess fuel supplied by the fuel pump 2 via a return manifold conduit 9 to the fuel tank 3. Also a return manifold conduit 10 connects each fuel injector 7 to the return fuel conduit 9.

Each fuel injector 7 comprises a solenoid pilot valve 11 controlled by the electronic controller 13. The controller 13 is powered by a battery 14 and is connected to receive input signals from a suitable engine timing sensor 12 and other engine operation sensors 12B–12F provided for sensing engine coolant temperature, engine speed, engine altitude or inlet manifold pressure, throttle position and supply chamber pressure. The controller 13 is operable to control the pressure regulator 8 to establish the fuel supply pressure in the supply chamber 5 and to selectively energize the injector solenoid valves 11, both in accordance with the received engine operation data and a predetermined schedule stored in its data processor to control the fuel injection pressure, fuel injection timing and duration of solenoid operation (i.e. solenoid energization pulse width).

Figure 2:
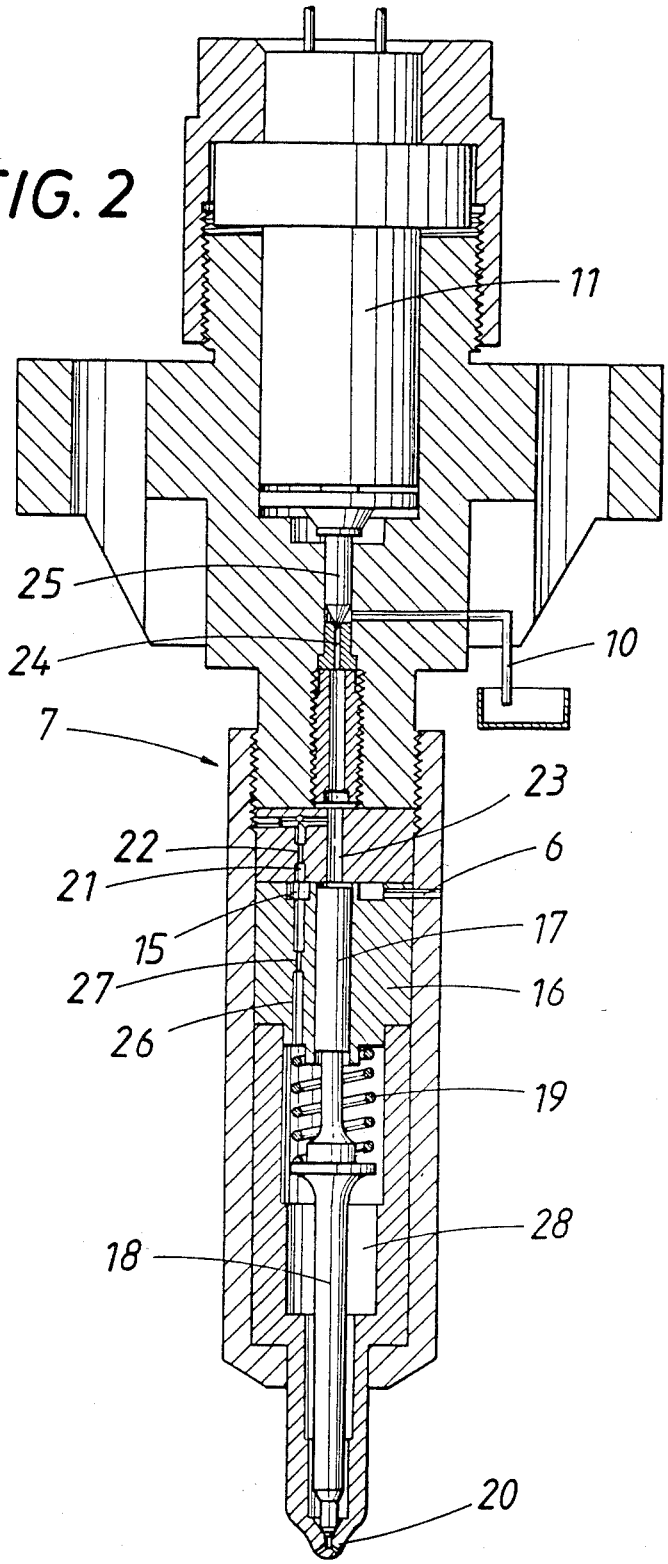
FIG. 2 is an axial section view, partly broken away and partly in section, of a fuel injector of the fuel injection system.

Referring to FIG. 2, the fuel injector 7 comprises an annular fuel inlet or entrance chamber 15 directly connected to the fuel supply chamber 5 via the fuel inlet manifold conduit 6. The annular fuel inlet chamber 15 is provided by an annular recess in the upper axial end of a generally cylindrical block 16 forming part of the fuel injector body. The block 16 has a central axial piston bore which receives and guides a piston 17 of an elongated injection valve needle 18 of the injector. A relatively weak spring 19 (e.g. providing a five to eight pound bias) encircles the injection valve needle 18 and is mounted between a needle flange and the block 16 to bias the needle in its closing axial direction into engagement with a nozzle valve seat 20 at the lower end of the injector body. The valve needle 18 thereby closes an injection valve opening for the usual injection nozzle orifices provided in the lower end of the injector body.

A fuel passage 21 connects the fuel inlet chamber 15 via a first constriction or orifice 22 to a needle valve control chamber or bore 23 which is coaxial with and directly above the axial mounting bore of the valve needle piston 17. The axial control chamber bore 23 is aligned with a solenoid valve needle 25 of the solenoid pilot valve 11 and is connected to the solenoid valve opening by an elongated, small diameter bore 24 slightly larger than the orifice 22. For example, the control chamber inlet orifice 22 has a diameter of 0.20 mm and the outlet bore 24 has a diameter of 0.30 mm. The solenoid valve needle 25 is normally biased into engagement with its valve seat to close the upper or outlet end of the small diameter outlet bore 24. When the solenoid pilot valve 11 is energized, the solenoid valve needle 25 is retracted from its seat to connect the control chamber 23 via the small diameter bore 24 to the return or pressure relief conduit 10. The pressure in the control chamber 23 is thereby released or relieved to rapidly reduce the control chamber pressure to an intermediate pressure level below the supply or inlet pressure established by the pressure regulator 8.

A second passage 26 connects the annular inlet chamber 15 via a second constriction or orifice 27 to an annular fuel storage or accumulator chamber 28. The accumulator chamber 28 surrounds the injection valve needle 18 and has a lower annular chamber portion surrounding the injection valve needle immediately above the injection valve opening. The volume of the accumulator chamber 28 and the diameter of its inlet orifice 27 are established in relationship to the fuel pressure range of the fuel supply chamber and the maximum volume of fuel to be injected. Also, the accumulator inlet orifice 27 is sized in relationship to the size and number of the nozzle injection orifices and for example has a 0.20 mm diameter when using four nozzle injection orifices each having a 0.26 mm diameter. Accordingly, during the fuel injection event the inlet flow rate to the accumulator chamber is substantially less than the injection rate. The volume of the storage chamber 28 is substantially greater than and preferably up to twenty to thirty times or more greater than the maximum volume of the fuel to be injected so that the injected fuel charge is largely stored or accumulated in the storage chamber 28 prior to the fuel injection event by the high pressure compression of fuel within the chamber 28 (and to some extent by the high pressure expansion of the accumulator chamber 28 depending on the structural design of the injector body).

The fuel injector 7 operates in the following manner. When the solenoid pilot valve 11 is deenergized, the small diameter outlet bore 24 for the control chamber 23 is closed and the fuel pressur throughout the entire interior of the fuel injector 7 between the injection valve seat 20 and the needle valve 25 increases to the pressure level established by the pressure regulator 8.

When the solenoid pilot valve 11 is energized, the solenoid valve needle 25 is retracted from its valve seat to permit fuel flow from the control chamber 23 through the small diameter outlet bore 24 to the retur manifold conduit 10. As a result, the pressure in the control chamber 23 is rapidly dumped to an intermediate pressure level because the outlet flow through the small diameter bore 24 is less restricted than the inlet flow through the inlet passage orifice 22. Although the resulting reduced pressure in the control chamber 23 and the force of the weak return spring 19 continue to provide a closing bias on the injection valve needle 18, the injection valve needle 18 is quickly retracted or lifted a predetermined very short distance against that closing bias by the opening hydraulic bias on the injection valve needle 18 provided by the inlet fuel pressure in the fuel storage chamber 28. In that regard, the diameter of the needle valve piston 17 is greater than the diameter of the valve seat 20 to provide a predetermined area differential for hydraulically biasing the needle valve 18 upwardly from its valve seat with the fuel pressure in the accumulator chamber 28. Accordingly, when the control chamber pressure is quickly dumped as described, the valve needle 18 is quickly lifted or retracted from its valve seat 20 by the fuel pressure in the accumulator 28 for the injection of fuel from the accumulator 28.

When the solenoid valve 11 is deenergized, the small diameter outlet bore 24 is closed and the fuel pressure in the control chamber 23 rapidly increases to the high inlet pressure. The increasing control chamber pressure together with the return spring 19 overcome the lower residual pressure in the accumulator chamber 28 (resulting from the injection of fuel) to rapidly return the injection valve needle 18 into engagement with its valve seat 20. The pressure in the fuel accumulator chamber 28 then increases to the high fuel inlet pressure to condition the injector for the next fuel injection event. Thus, the fuel accumulator chamber 28 is fully charged with fuel at the fuel inlet pressure prior to each fuel injection event, the fuel injection needle 18 is momentarily retracted or lifted by momentarily reducing the fuel pressure in the fuel control chamber 23 to inject fuel at the desired rate and in the desired amount and during the relatively long interval between fuel injection events, the fuel pressure in the fuel accumulator chamber 28 increases to the inlet pressure.

Since the fuel in the accumulator 28 is compressed to the high inlet pressure prior to the fuel injection event and because the accumulator volume substantially exceeds the volume of the injected fuel charge by a factor of up to twenty or thirty or more and because during the fuel injection event the inlet flow rate to the accumulator 28 is restricted by the accumulator inlet orifice 27 to substantially less than the fuel injection rate, the accumulator 28 supplies the principal portion of the fuel for fuel injection and the accumulator inlet orifice 27 prevents significant additional fuel from being supplied to the accumulator chamber 28 during the fuel injection event and accordingly allows the accumulator pressure to drop significantly below the high inlet pressure. Consequently, when the solenoid pilot valve 11 is deenergized to rapidly increase the control chamber pressure, the injection valve needle 18 is rapidly closed to provide a clean injection cut-off and thereby provide good overall fuel atomization and prevent end of injection dribble or fuel throttling. Also, the relatively slight additional fuel flow through the accumulator inlet orifice 27 during the fuel injection event when the injection valve is open will not affect the accurate control of the injected fuel volume by the solenoid pilot valve 11. Thus, the provision of both a regulated inlet pressure and pulse width control of the solenoid pilot valve 11 throughout the full speed and load operating range of the engine 1 provides for accurately controlling both the injected fuel volume and the rate of fuel injection.

The rate at which the fuel is discharged or injected through the nozzle injection orifices when the injection valve needle 18 is momentarily retracted or lifted from its seat is established by the inlet or supply pressure. Thus, the controller 13 provides the mean for establishing not only the injection timing and injected fuel volume but also the fuel injection rate, in accordance with the engine operating conditions including engine speed, engine coolant temperature, engine altitude or air inlet manifold pressure, and throttle position. Since the volume of the accumulator chamber 28 of the fuel injector 7 substantially exceeds the maximum volume of fuel to be injected throughout the full range of operating conditions of the engine, the size of the discrete charge of fuel injected is controlled by establishing the inlet or supply pressure (for example at any pressure within the range of 2,000 to 16,000 psi) and the duration of solenoid energization (for example for any duration within a range of one-half to four milliseconds). During relatively low inlet or supply pressure operation normally accompanying low engine speed, the solenoid energization interval is used to accurately control the size of the injected fuel charge. At higher speeds and fuel supply pressures, the inlet or supply pressure is preferably regulated by the controller 13 in conjunction with the regulation of the duration of energization of the solenoid valve 11 to control the size of the injected fuel charge. In that regard, since the volume of the compressed fuel charge stored in the accumulator chamber 28 is dependent on the inlet pressure, the injected charge volume is dependent in part on the inlet pressure. Likewise, since the opening interval of the injection valve needle 18 affects the size of the injected fuel charge, the size of the injected fuel charge is also dependent in part on the interval of energization of the solenoid valve 11.

The fuel supply pump 2 is continuously operated by the engine 1 to supply fuel under pressure to the fuel supply chamber 5 so that the fuel pressure within each injector storage chamber 28 is restored to the inlet or supply pressure between fuel injection events.

Of substantial significance is that the fuel accumulator chamber 28 has a volume substantially in excess of the predetermined maximum volume of fuel to be injected and the accumulator chamber 28 is connected to the injector inlet via a constriction which limits the flow to the accumulator chamber 28 during the fuel injection event. Accordingly, the accumulator pressure decreases substantially below the inlet or supply pressure to provide rapid injection valve closure and clean fuel cut-off at the end of the fuel injection event. Also, the inlet restriction 27 to the fuel accumulator chamber 28 provides for isolating the accumulator chamber 28 during the fuel injection event from any pressure waves generated elsewhere in the high pressure fuel injection system. Therefore, any such pressure wave cannot adversely affect the fuel injection rate or volume or the injection timing or duration.

As will be apparent to persons skilled in the art, various modifications, adaptations and variations of the foregoing specific disclosure can be made without departing from the teachings of the present invention.

I claim:

1. In a method for the momentary injection of a discrete charge of fuel, of a selected volume within a range having a maximum volume and at a predetermined rate of injection, into a cylinder of a internal combustion engine with a fuel injector having a fuel injector body with a fuel injection valve opening and a valve seat surrounding the injection valve opening, an elongated valve member mounted within the valve body for engagement with the valve seat for closing the valve opening and to be momentarily shifted in opposite axial opening and closing directions thereof to be momentarily lifted from the valve seat for momentarily opening the valve member for said momentary injection of a discrete charge of fuel, the fuel injector body having a fuel inlet for receiving fuel at a continuous high inlet pressure, a first fuel pressure chamber connected to the fuel inlet to be pressurized to said high inlet pressure and in communication with the injection valve opening on the upstream side thereof for delivering fuel under pressure for fuel injection when the valve member is momentarily lifted from its valve seat, the valve member being hydraulically biased in its opening direction by said first fuel chamber pressure, closing bias means, including a second fuel pressure chamber connected to the fuel inlet to be pressured to said high inlet pressure to hydraulically bias the valve member in its closing direction at said high inlet pressure, said closing bias means with said closing hydraulic bias at said high inlet pressure being operable to hold the valve member in engagement with its valve seat against said opening hydraulic bias at said high inlet pressure, the fuel injection method comprising the steps of providing said first fuel chamber as an accumulator chamber with an accumulator volume substantially larger than said maximum volume, connecting said accumulator chamber to the fuel inlet by a first passage restriction to accumulate said substantially larger accumulator volume of fuel in said accumulator chamber at said high inlet pressure prior to said momentary fuel injection and so that the pressure of said accumulator volume of fuel in said accumulator chamber is isolated from the continuous high inlet pressure at the fuel inlet during the momentary opening of the valve member so as to decrease to substantially below said high inlet pressure during the momentary opening of the valve member for said momentary fuel injection and therefore so that the fuel injection rate is dependent on the volume of the accumulator chamber and the accumulator chamber pressure prior to said momentary fuel injection, connecting said second pressure chamber to the fuel inlet by a second passage restriction to pressurize said second chamber to said high inlet pressure, and momentarily reducing said second chamber pressure to substantially below said high inlet pressure to rapidly open the valve member by said accumulator chamber pressure and then, after the pressure of said accumulator volume of fuel in said accumulator chamber decreases to substantially below said high inlet pressure, rapidly close the valve member by said second chamber pressure to produce said momentary injection of a discrete charge of fuel and selecting the volume of the injected charge and rate of fuel injection by controlling said continuous inlet pressure and the interval of momentary reduction of said second chamber pressure.

2. A method for the momentary injection of a discrete charge of fuel according to claim 1 wherein the step of controlling said continuous inlet pressure comprises the step of regulating said continuous inlet pressure to establish the predetermined rate of fuel injection.

3. A method for the momentary injection of a discrete charge of fuel according to claim 1 wherein the step of controlling the interval of momentary reduction of said second chamber pressure comprises the steps of providing a solenoid operated pressure relief valve operable for momentarily reducing said second chamber pressure and controlling the pulse width of an electrical pulse for establishing the duration of operation of the solenoid operated pressure relief valve.

4. A method for the momentary injection of a discrete charge of fuel according to claim 1 wherein the step of controlling said continuous inlet pressure and the interval of momentary reduction of said second chamber pressure is provided by a programmed electronic controller.

5. For a fuel injection system for the momentary injection of a discrete charge of fuel, of a selected volume within a range having a maximum volume and at a predetermined rate of injection, into a cylinder of an associated internal combustion engine, a fuel injector with a fuel injector body having a fuel injection valve opening and a valve seat surrounding the injection valve opening, an elongated valve member mounted within the valve body for engagement with the valve seat for closing the valve opening and to be momentarily shifted in opposite axial opening and closing directions thereof to be momentarily lifted from the valve seat for momentarily opening the valve member for said momentary injection of a discrete charge of fuel, the fuel injector body having a fuel inlet for receiving fuel at a continuous high inlet pressure, a first fuel pressure chamber connected to the fuel inlet to be pressurized to said high inlet pressure and in communication with the injection valve opening on the upstream side thereof for delivering fuel under pressure for fuel injection when the valve member is lifted from its valve seat, the valve member being dimensioned to be hydraulically biased in its opening direction by said first fuel chamber pressure, closing bias means, including a second fuel pressure chamber in the fuel injection body connected to the fuel inlet to be pressurized to said high inlet pressure to hydraulically bias the valve member in its closing direction at said high inlet pressure, said closing bias means with said closing hydraulic bias at said high inlet pressure being operable to hold the valve member in engagement with its valve seat against said opening hydraulic bias at said high inlet pressure, means for momentarily reducing said second chamber pressure for momentarily lifting the valve member from the valve seat with said opening hydraulic bias at said high inlet pressure, said first fuel chamber being an accumulator chamber with an accumulator volume substantially larger than said maximum volume, a first passage restriction connecting said accumulator chamber to the fuel inlet for pressurizing said accumulator chamber to said high inlet pressure prior to the said momentary fuel injection, to make the injected volume and rate of injection dependent on said high inlet pressure and to make the pressure of said accumulator volume of fuel in said accumulator chamber isolated from the continuous high inlet pressure at the fuel inlet during the momentary opening of the valve member so as to decrease to substantially below said high inlet pressure during the momentary opening of the valve member for said momentary fuel injection and therefore so that the fuel injection rate is dependent on the volume of the accumulator chamber and the accumulator chamber pressure prior to said momentary fuel injection, a second passage restriction connecting said second chamber to the fuel inlet to pressurize said second chamber to said high inlet pressure to close the valve member and to permit momentarily reducing said second chamber pressure for momentarily lifting the valve member by said high inlet pressure in said accumulator chamber and then, after the pressure of said accumulator volume of fuel in said accumulator chamber decreases to substantially below said high inlet pressure, rapidly closing the valve member by said second chamber pressure, to produce said momentary injection of a discrete charge of fuel, and control means for controlling the fuel injection volume and rate of fuel injection by controlling the said continuous inlet pressure and the interval of momentary reduction of said second chamber pressure.

* * * * *